United States Patent [19]

Cohen et al.

[11] Patent Number: 4,605,269

[45] Date of Patent: Aug. 12, 1986

[54] PRINTED CIRCUIT BOARD HEADER HAVING COAXIAL SOCKETS THEREIN AND MATABLE COAXIAL PLUG HOUSING

[75] Inventors: Thomas S. Cohen, Camp Hill; Douglas F. Finan, Harrisburg, both of Pa.

[73] Assignee: AMP Incorporated, Harrisburg, Pa.

[21] Appl. No.: 622,615

[22] Filed: Jun. 20, 1984

[51] Int. Cl.[4] ..... H01R 9/05; H01R 9/09

[52] U.S. Cl. ..... 339/17 LC; 339/132 B; 339/177 R

[58] Field of Search ..... 339/17 R, 17 C, 17 LC, 339/177 R, 177 E, 132 R, 132 B

[56] References Cited

U.S. PATENT DOCUMENTS

| | | | |
|---|---|---|---|
| 3,551,874 | 12/1970 | Volinskie | 339/17 R |
| 3,852,700 | 12/1974 | Haws | 339/177 R |
| 4,008,941 | 2/1977 | Smith | 339/17 LC |
| 4,360,244 | 11/1982 | Forney, Jr. et al. | 339/177 R |
| 4,385,795 | 5/1983 | Endoh et al. | 339/17 LC |
| 4,410,230 | 10/1983 | San Miguel | 339/17 LC |
| 4,451,107 | 5/1984 | Dola et al. | 339/17 LC |

FOREIGN PATENT DOCUMENTS

| | | | |
|---|---|---|---|
| 3117320 | 4/1982 | Fed. Rep. of Germany | 339/177 R |
| 922951 | 4/1963 | United Kingdom | 339/177 R |
| 483730 | 12/1975 | U.S.S.R. | 339/177 R |

*Primary Examiner*—Neil Abrams

[57] ABSTRACT

A printed circuit board header for a row of coaxial sockets comprises a dielectric housing having a series of passageways extending therethrough in which coaxial sockets are releasably disposed. Each of the coaxial sockets include an outer contact member, a dielectric member disposed within the outer contact member and a center contact member having a first contact section extending along a longitudinal bore of the dielectric member and a second contact section extending exteriorly of the dielectric member. A contact element of the outer contact member extends exteriorly thereof and also extends parallel with respect to the second contact section so that the second contact sections and the contact elements are matable with respective holes in a printed circuit board. The outer contact members and the respective passageways are provided with securing members securing the coaxial sockets therein. Securing sections are provided on the housing to secure the housing on a printed circuit board in one direction so that the coaxial sockets extend parallel to the printed circuit board or in another direction so that the coaxial sockets are normal to the printed circuit board.

This the coaxial socket housing includes latching sections latchably engaging flexible latching members of a coaxial plug housing matable with the coaxial socket housing so that the coaxial plugs are electrically matable with respective coaxial sockets. The matable housings have polarized matable sections and projections extend outwardly from the front surface of the coaxial plug housing protecting forward sections of the coaxial plugs.

4 Claims, 4 Drawing Figures

PRINTED CIRCUIT BOARD HEADER HAVING COAXIAL SOCKETS THEREIN AND MATABLE COAXIAL PLUG HOUSING

FIELD OF THE INVENTION

This invention relates to electrical connectors and more particularly to a printed circuit board header having coaxial sockets therein which is latchable with a matable housing, the coaxial sockets being electrically matable with respective coaxial plugs in the housing.

BACKGROUND OF THE INVENTION

U.S. Pat. No. 4,008,941 discloses a printed circuit board header which comprises a housing having annular cavities therein arranged in a row. Two parallel passages in communication with each of the annular cavities open to the rear surface of the housing with one of the passages being located in the center of the cavity and the other of the passages being in alignment with the wall of the cavity. A center contact member is disposed in each of the center passages and includes a front contact section disposed in the cavity and a rear contact section that is bent at right angles for disposition into a hole of the printed circuit board and electrical connection with a signal path thereon. A metal sleeve is disposed in engagement with the walls of each of the cavities and includes a rear contact member that extends through the other passage and is bent at right angles forward of the rear contact section of the center contact member for disposition in another hole of the printed circuit board and electrical connection with a ground path thereon, the rear contact sections and the rear contact members being in alignment. The housing thus serves as the dielectric spacer between the signal and ground contact members in the formation of the coaxial sockets which electrically mate with complementary coaxial plugs disposed in a matable housing that latches to the coaxial socket housing.

In this construction, the front ends of the coaxial plugs are not protected and are susceptible to damage; the impedance is not properly matched because the housing serves as the dielectric between the signal and ground contacts; and, if a signal or ground contact is damaged, repair would be time-consuming and difficult.

SUMMARY OF THE INVENTION

According to the present invention, a printed circuit board header for a row of coaxial sockets comprises a dielectric housing having a series of passageways extending therethrough in which coaxial sockets are disposed. Each of the coaxial sockets include an outer contact member, a dielectric member disposed within the outer contact member and a center contact member having a first contact section extending along a longitudinal bore of the dielectric member and a second contact section extending exteriorly of the dielectric member. A contact element of the outer contact member extends exteriorly thereof and also extends parallel with respect to the second contact section so that the second contact sections and the contact elements are matable with repsective holes in a printed circuit board. The outer contact members and the respective passageways are provided with securing members securing the coaxial sockets therein. Securing sections are provided on the housing to secure the housing on a printed circuit board in one direction so that the coaxial sockets extend parallel to the printed circuit board or in another direction so that the coaxial sockets are normal to the printed circuit board.

According to another feature of the present invention, the coaxial socket housing includes latching sections to which are latchably engaged flexible latching members of a coaxial plug housing matable with coaxial socket housing so that coaxial plugs secured in the coaxial plug housing are electrically matable with respective coaxial sockets. The matable housings have polarized matable sections and projections extend outwardly from the front surface of the coaxial plug housing protecting forward sections of the coaxial plugs that extend outwardly from the front surface and the projections extend along top and bottom surfaces of the header housing thereby stabilizing the housings when they are mated together.

DETAILED DESCRIPTION OF THE INVENTION

Figure 1:
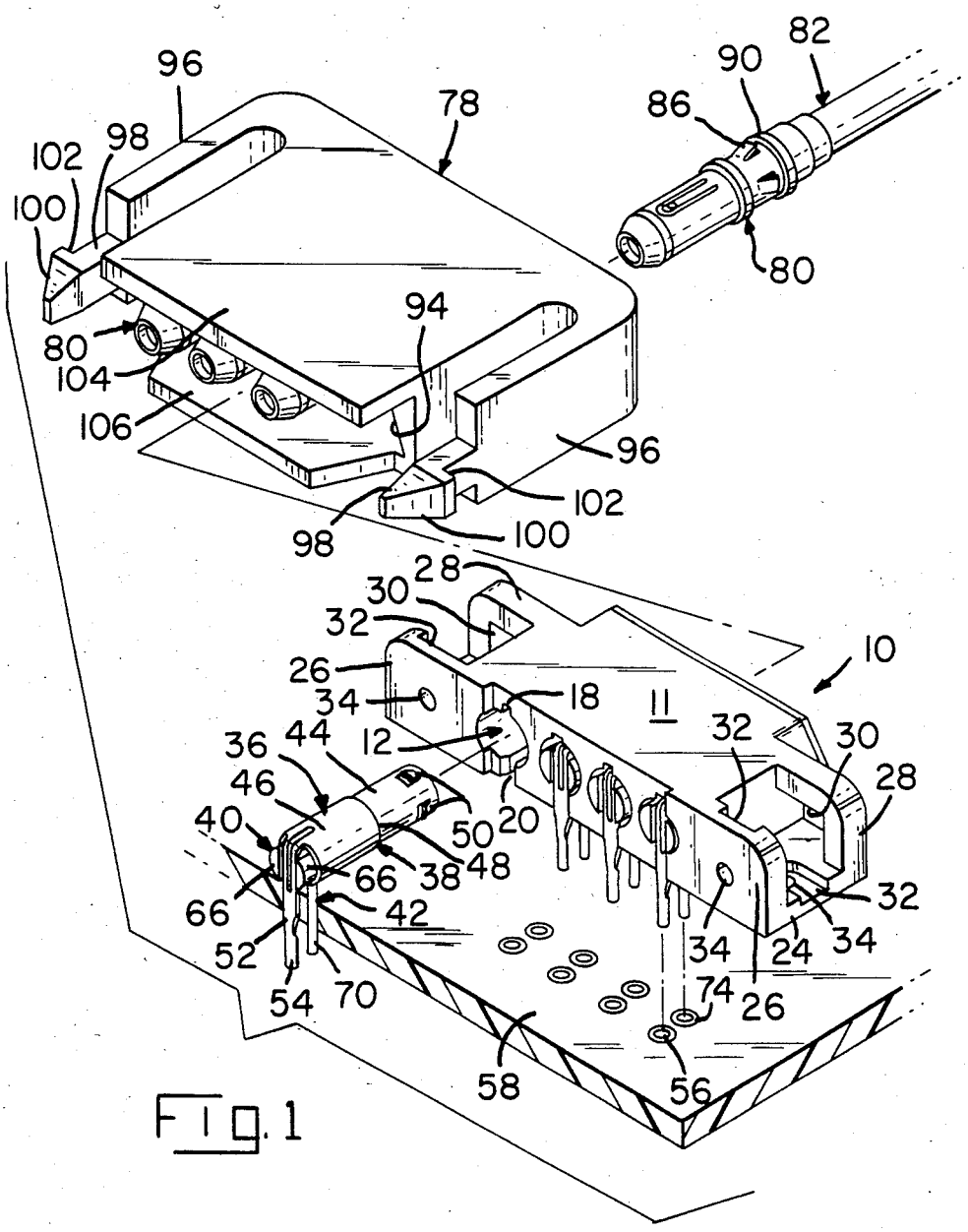
FIG. 1 is a perspective and exploded view of a coaxial socket printed circuit board header with a coaxial socket exploded therefrom and also exploded from a printed circuit board and a coaxial plug housing that is to be latchably mated with the header with a terminated coaxial plug exploded thereform.

A coaxial socket printed circuit board header 10 includes a housing 11 that is molded from a suitable dielectric material and includes a row of passageways 12 extending therethrough. Each of passageways 12 has a front stop surface 14, a rear stop surface 16, a recess 18 extending inwardly from the rear surface of housing 11 and slot 20 opposite recess 18 which also extends inwardly from the rear surface of housing 11. A front section 22 of header 10 has sloping sides. Mounting sections 24 and 26 along with latching sections 28 extend outwardly from the sides of housing 11. Mounting sections 24 and 26 are disposed normal to one another while latching sections 28 are disposed parallel with respect to mounting sections 26 and have openings 30 extending therethrough. Recesses 32 are located in outer surfaces of sections 24 and 26 and holes 34 extend therethrough.

Figures 2, 4:
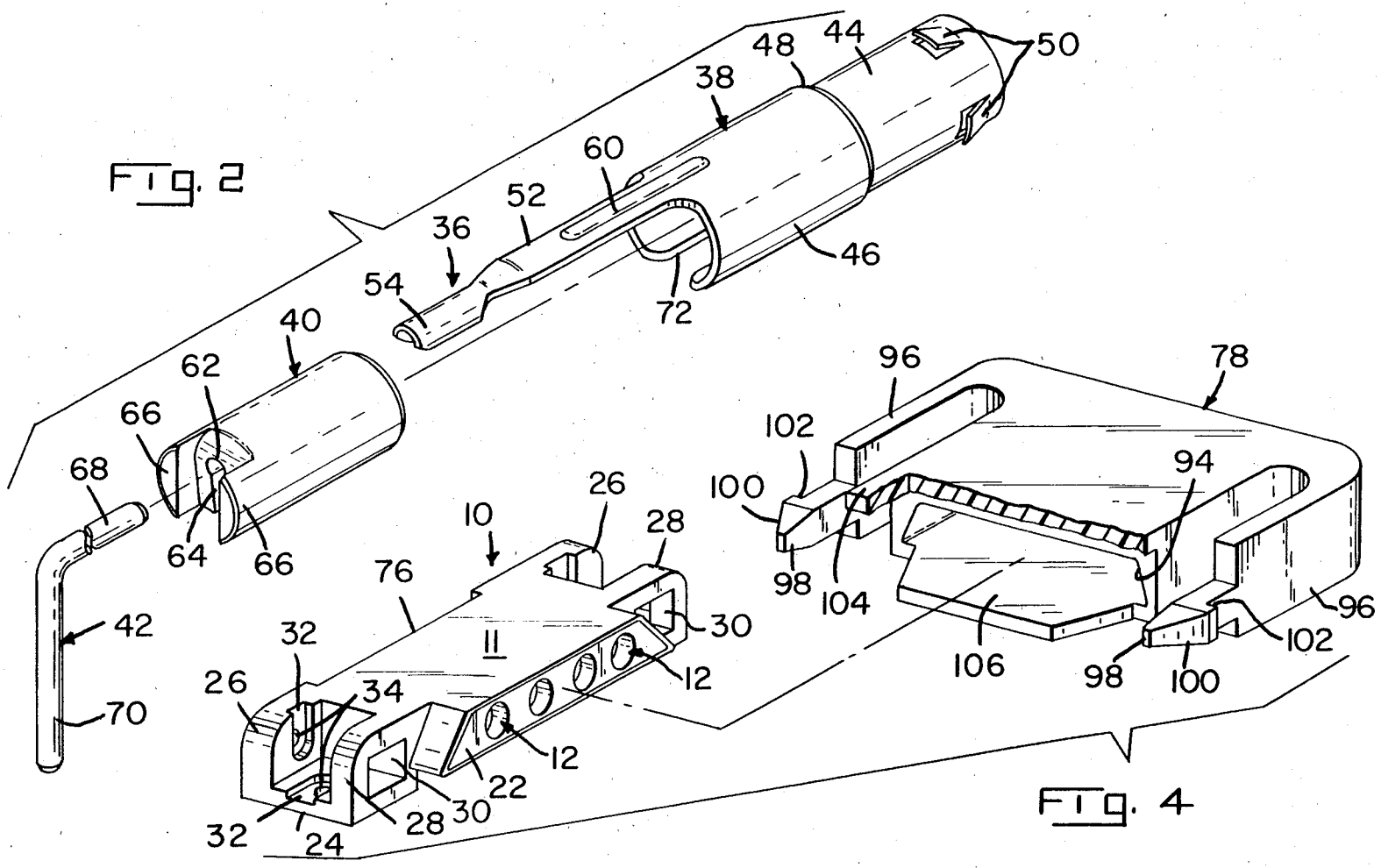
FIG. 2 is a perspective and exploded view of the elements of a coaxial socket.
FIG. 4 is a perspective and exploded view of the header and housing showing their mating and latching sections.
Figure 3:
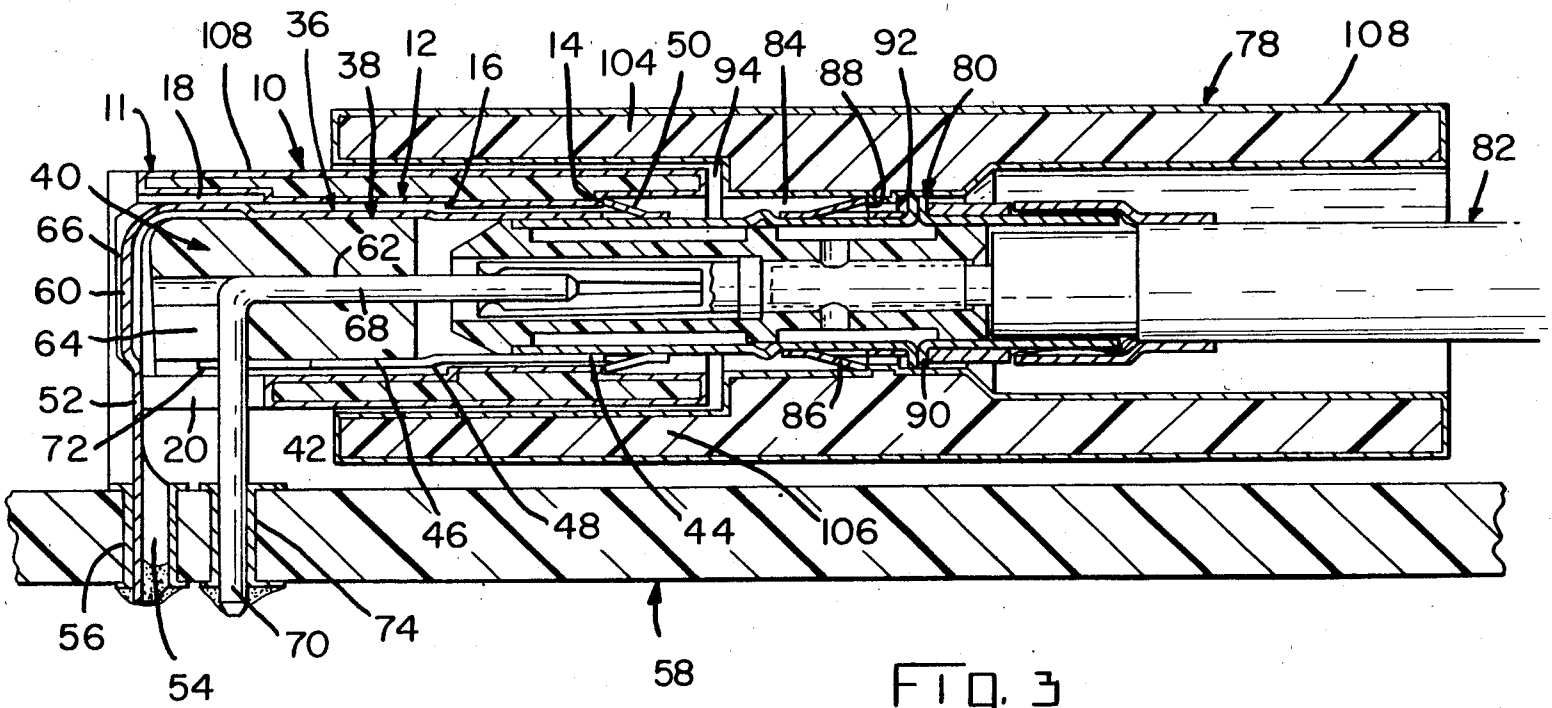
FIG. 3 is a cross-sectional view of the coaxial socket header secured onto a printed circuit board with a coaxial socket electrically connected respectively to signal and ground paths thereon and coaxial plug housing matable with the header with a coaxial plug electrically connected to the coaxial socket and electrically terminated to a coaxial cable.

Coaxial sockets 36, as shown in FIGS. 1 through 3, are latchably secured in respective passageways 12 of housing 11 thereby forming header 10. Each of coaxial sockets 36 comprises an outer or ground contact member 38, a dielectric member 40 and a center or signal contact member 42. Outer contact member 38 is stamped and formed from a suitable metal having desirable spring and electrical characteristics and includes a front section 44 and a rear section 46 which are separated from one another by a shoulder 48; the diameter of front section 44 is slightly less than the diameter of rear section 46. Latches 50 extend outwardly from front section 44 for engagement with front stop surface 14 in passageway 12 when coaxial socket 36 is positioned therein and shoulder 48 will cooperate with rear stop surface 16 to limit movement of coaxial socket 36 within passageway 12 as shown in FIG. 3. Coaxial socket 36 can be removed from passageway 12 by using a tubular section of a tool that slides along the exterior surface of section 44 thereby depressing latches 50 to free them from stop surface 14 enabling coaxial socket 36 to be slid along passageway 12 and removed therefrom.

A rear contact element 52 extends outwardly from rear section 46 and terminates into a contact section 54 of almost circular configuration for frictional electrical engagement with a plated through hole 56 in printed circuit board 58 so that it can be flow-soldered thereto, plated through hole 56 being part of a ground plane on board 58. Contact sections 54 will snugly engage plated through holes 56 to hold header 10 on board 58 until it is secured thereon and contact sections soldered to plated through holes 56. An elongated embossment 60 is located in part of rear contact element 52 and extends into rear section 46 of outer contact member 38 to strengthen rear contact element 52 and embossment 60 is disposed in recess 18 in passageway 12 as shown in FIG. 3 when coaxial sockets 36 are secured in passageways 12.

Dielectric member 40 is molded from a suitable dielectric material having the desired dielectric characteristics and is of circular configuration for snug disposition within rear section 46 of outer contact member 38 as shown in FIG. 3 with shoulder 48 serving as a stop limiting the movement of dielectric member 40 within section 46. A bore 62 extends through dielectric member 40 and is in communication with a slot 64 which extends inwardly from the bottom of dielectric member 40. As shown in FIG. 3, the rear surface of dielectric member 40 has an arcuate configuration at the upper part which then slopes slightly inwardly. Projections 66 extend outwardly from the rear surface of dielectric member 40.

One leg 68 of center contact member 42 is snugly disposed within bore 62 of dielectric member 40 and a front part of leg 68 extends outwardly from a front surface of dielectric member 40 thereby forming a contact section that extends coaxial with respect to front section 44 of outer contact member 38. Another leg 70 of center contact member 42 is at right angles with respect to leg 68 and is disposed in slot 64 and extends outwardly from dielectric member 40 and along slot 72 in rear section 46 of outer contact member 38 and along slot 20 in housing 11 for disposition in plated through hole 74 in printed circuit board 58 as shown in FIG. 3. Slots 20, 64 and 72 are in alignment.

In assembly, dielectric member 40 with center contact member 42 frictionally disposed therein and with rear contact element 52 in its normal position as shown in FIG. 2 is inserted into rear section 46 of outer contact member 38 whereafter rear contact element 52 is bent along the rear surface of dielectric member 40 in between projections 66 until rear contact element 52 is disposed substantially parallel with respect to leg 70 of center contact member 42 as shown in FIGS. 1 and 3 thereby forming coaxial socket 36.

Coaxial sockets 36 are inserted into respective passageways 12 of header 10 whereby they are latched therein by latches 50 which are disposed in alignment with stop surfaces 14 and shoulders 48 are disposed adjacent stop surfaces 16, embossments 60 are disposed in recesses 18 and legs 70 of center contact members 42 and rear contact elements 52 of outer contact members 38 are disposed within slots 20 of housing 11. With rear contact elements 52 being disposed between projections 66 of dielectric members 40, dielectric members 40 are stabilized within rear sections 46 of outer contact members 38 and with rear contact elements 52 disposed in respective slots 20 of housing 11, this stablilizes coaxial sockets 36 in position in passageways 12.

The parts of housing 11 containing mounting sections 24, 26 and latching sections 28 project downwardly from the part of housing 11 containing passageways 12 and front section 22 so that when header 10 is mounted on printed circuit board 58 with header 10 being disposed parallel to board 58, mounting sections 24 engage the top surface of board 58 and are secured in position thereon via bolts, screws or rivets being disposed in holes 34 in recesses 32 which mate with complimentary holes in board 58. In this way, header 10 with coaxial sockets 36 latchably secured in passageways 12 thereof enables a number of coaxial sockets to have their center and outer contact members disposed in respective plated through holes or holes in printed circuit board 58 that are respectively connected to signal and ground paths thereon for flow-soldering connection thereto. Also a space is provided between the section of header 10 containing passageways 12 and the top surface of board 58 to enable cleaning of the board in this area.

Alternatively, header 10 can be mounted on an upper surface of board 58 so that header 10 is disposed in a normal direction relative to board 58 and this is accomplished by rear contact elements 52 being maintained in their normal unbent position as shown in FIG. 2 and legs 70 of center contact members 42 are disposed parallel thereto instead of being at a right angle with respect to legs 68 and they extend along bores 62 instead of being positioned in slots 64. Dielectric members 40 are snugly positioned in rear sections 46 of outer contact members 38 and legs 68 of center contact members 42 are snugly positioned in bores 62 of dielectric members 40 so that dielectric members 40 and center contact members 42 therein remain in position in outer contact members 38 when legs 70 and outer contact elements 54 are not at right angles. In mounting header 10 on the board 58 in this manner, mounting sections 26 are disposed in engagement with the upper surface of board 58 and bolts, screws or rivets are disposed in holes 34 in recess 32 thereof in correspondence with holes in board 58 thereby securing header 10 in position thereon with legs 70 of center contact members 42 and contact sections 54 of rear contact elements 52 being disposed in respective holes 56 and 74 of printed circuit board 58 and subsequently flow soldered thereto. A recess 76 is located in the rear surface of header 10 so that the part of header 10 containing passageways 12 is spaced from the upper surface of board 58 to enable the area between the upper surface of board 58 and header 10 to be cleaned as described above.

A housing member 78 containing coaxial plugs 80, which are terminated to coaxial cables 82 is latchably matable with header 10 to electrically connect the center and outer contact members of coaxial plugs 80 with respective center and outer contact members of coaxial sockets 36 as shown in FIG. 3. Housing member 78 is molded from a suitable dielectric material having the desirable dielectric characteristics and it includes passageways 84 extending therethrough in which coaxial plugs 80 are latchably secured in position therein by latches 86 being directed towards stop surfaces 88 in passageways 84 and annular projections 90 being disposed adjacent stop surfaces 92 in passageways 84 as shown in FIG. 3. Coaxial plugs 80 are of the type disclosed in U.S. Pat. No. 3,235,834 and no further description thereof is deemed to be necessary.

Front sections of coaxial plugs 80 are partly disposed in cavity 94 in the front section of housing member 78 which has a configuration complementary with front section 22 of housing 11 thereby polarizing the mating of housing member 78 with housing 11 so that coaxial plugs 80 can be electrically mated with respective coaxial sockets 36 when housing member 78 is latchably connected to header 10 via stiffly flexible integral latching members 96 that extend along respective sides of housing member 78. Latching members 96 include latching sections 98 at the front ends thereof which have camming surfaces 100 that engage with openings 30 in latching sections 28 of header 10 to cam latch members 96 inwardly and latching surfaces 102 engage with the inner surfaces of latching sections 28 thereby latching housing member 78 to header 10. Inward pressure on latching members 96 free latching surfaces 102 from latching sections 28 thereby enabling housing members 78 to be unlatched and removed from header 10 thereby disconnecting coaxial plugs 80 from coaxial sockets 36.

Extensions 104 and 106 extend outwardly from a front surface of housing member 78 and extension 104 extends along a top surface of header 10 between header 10 and board 58 while extension 106 extends along a bottom surface of header 10 when housing member 78 is latchably mated with header 10 as shown in FIG. 3. Extensions 104 and 106 protect the front sections of coaxial plugs 80 that extend outwardly from the front surface of housing member 78 and stabilize the housing member 78 during matable engagement with header 10 and when latched thereto. If desired, the outer and inner surfaces including those of passageways 12 and 84 of header 10 and housing members 78 can be plated with a thin coating of metal 108 in accordance with conventional plating practices thereby shielding the connections between coaxial sockets 36 and respective coaxial plugs 80.

As can be discerned a printed circuit board header having coaxial sockets is mounted on a printed circuit board with signal and ground contacts being connectable to signal and ground paths on the printed circuit board and with the coaxial sockets extending parallel to the board or normal thereto. A coaxial plug housing has coaxial plugs therein and is latchably mounted to the header with coaxial plugs thereof being electrically matable with respective coaxial sockets and extensions are provided by the coaxial plug housing at the front end thereof to protect front sections of the coaxial plugs and to stabilize matable engagement of the coaxial plug housing with the header.

We claim:

1. A printed circuit board header of coaxial sockets, comprising: a dielectric housing having a series of passageways extending therethrough; coaxial sockets disposed in respective passageways, each of said coaxial sockets including an outer contact member, a dielectric member and a center contact member, said outer contact member being a tubular member, said dielectric member being disposed in said tubular member and said center contact member having a first section and a second section, said first section disposed in said dielectric member and including a first contact section extending outward from a front surface of said dielectric member coaxial with said tubular member, said second section extending outwardly from said tubular member for electrical connection with a signal path on a printed circuit board, said tubular member including a rear contact element extending outwardly from a rear end of said tubular member and extending substantially parallel to said second section for electrical connection with a ground plane on the printed circuit board; securing means provided by the tubular members and the passageways for releasably securing the coaxial sockets in the passageways; and mounting means on said housing for mounting the housing on the printed circuit board, said dielectric member has a slot in which said second section of said center contact member is disposed so that said second section is at right angles to said first section.

2. A printed circuit board header as set forth in claim 1, wherein said dielectric member has projections extending outwardly from a rear section thereof, said rear contact element being disposed along a rear surface of said dielectric member and between said projections so that said rear contact element is substantially parallel to said second section.

3. A printed circuit board header as set forth in claim 1, wherein said tubular member and said housing have slots in alignment with the slot in the dielectric member along which the second section extends.

4. A printed circuit board header as set forth in claim 3, wherein the rear contact element is disposed in the slot of the housing.

* * * * *